US009474919B2

(12) United States Patent
Petrossian

(10) Patent No.: US 9,474,919 B2
(45) Date of Patent: Oct. 25, 2016

(54) DAMPER POSITIONING LOCK

(76) Inventor: Vahik Petrossian, Glendale, CA (US)

( * ) Notice: Subject to any disclaimer, the term of this patent is extended or adjusted under 35 U.S.C. 154(b) by 2091 days.

(21) Appl. No.: 11/539,847

(22) Filed: Oct. 9, 2006

(65) Prior Publication Data

US 2008/0113613 A1 May 15, 2008

(51) Int. Cl.
*A62C 2/12* (2006.01)
*F24F 13/14* (2006.01)

(52) U.S. Cl.
CPC *A62C 2/12* (2013.01); *F24F 13/14* (2013.01)

(58) Field of Classification Search
CPC ..... A62C 2/12; F24F 13/14
USPC ..... 454/369, 347, 348, 358, 333; 126/259
See application file for complete search history.

(56) References Cited

U.S. PATENT DOCUMENTS

| | | | | | |
|---|---|---|---|---|---|
| 211,810 | A | * | 1/1879 | Walker | 126/295 |
| 920,694 | A | * | 5/1909 | Tribur | F24F 13/1426 126/295 |
| 1,125,416 | A | * | 1/1915 | Watson | 126/287.5 |
| 1,282,811 | A | | 10/1918 | Goldburg | |
| 1,672,318 | A | * | 6/1928 | Hinrich | 126/295 |
| 1,885,548 | A | | 11/1932 | Rosenberg | |
| 2,339,666 | A | * | 1/1944 | Anderson | 74/527 |
| 2,345,997 | A | | 4/1944 | Anderson | |
| 2,649,728 | A | * | 8/1953 | Buttner | 454/342 |
| 3,073,564 | A | | 1/1963 | Alter | |
| 3,119,279 | A | * | 1/1964 | Reece | 74/528 |
| 3,633,600 | A | * | 1/1972 | Sadamori | 137/77 |
| 4,113,230 | A | * | 9/1978 | McCabe | 251/305 |
| 4,176,690 | A | | 12/1979 | Clark et al. | |
| 4,219,185 | A | * | 8/1980 | McCabe | 251/308 |
| 4,276,871 | A | | 7/1981 | Lindtveit | |
| D300,778 | S | | 4/1989 | Giannone | |
| 5,169,121 | A | | 12/1992 | Blanco et al. | |
| 5,787,919 | A | * | 8/1998 | Pyle | 137/79 |
| 2006/0014486 | A1 | * | 1/2006 | Perrin | 454/369 |

FOREIGN PATENT DOCUMENTS

| | | | | |
|---|---|---|---|---|
| EP | 0895884 | A | | 2/1999 |
| FR | 525434 | A | | 9/1921 |
| GB | 1169164 | A | | 10/1969 |
| GB | 2392092 | A | * | 2/2004 |
| JP | 60235939 | a | | 11/1985 |

* cited by examiner

*Primary Examiner* — Helena Kosanovic
(74) *Attorney, Agent, or Firm* — Kelly & Kelley, LLP

(57) ABSTRACT

A damper positioning lock includes a plate having a plurality of recesses along an arcuate edge and a damper positioning handle pivotally associated with the plate. A mechanism is associated with the handle for selectively engaging a selected one of the recesses.

16 Claims, 7 Drawing Sheets

DAMPER POSITIONING LOCK

BACKGROUND OF THE INVENTION

The present invention relates, in general, to damper regulators for controlling the flow or air or the like in the ducts of a heating, ventilating or air conditioning (HVAC) system. More particularly, the present invention relates to a damper positioning lock.

It is well-known in ducted heating, ventilating or air conditioning systems to provide, at selected number of points, regulating damper assemblies 20, such as that shown in FIG. 1, for controlling the rate of flow of air or the like through the ducts of the HVAC system. Such known assemblies 20 generally include a blade 22 dimensioned to conform substantially to the cross-section of a flue or duct 24 through which the passage of air or the like is regulated (e.g., a generally circular blade 22 for a generally cross-sectionally circular duct 24). The blade 22 is attached to a shaft 26 which is itself rotatably connected to the duct 24 by bearings such that the blade 22 is pivotable within the duct 24 as the shaft 26 is rotated. One end of the shaft 26 extends out from the duct 24 and through an aperture (not shown) in the hub of a simple handle or lever 28 where the aperture is sized and shaped to engage the shaft 26 (e.g., a generally square aperture for a cross-sectionally square shaft 26). The shaft 26 further extends through an aperture (not shown) of a bracket 30 connected to the exterior of the duct 24 where the shaft 26 is rotatable within the aperture of the bracket 30. A user rotating the lever 28 causes the shaft 26 to rotate within the duct 24, and the blade 22 therewith so that the blade 22 is able to be rotated between configurations where the duct 24 is in an open configuration, allowing air or the like to pass through the duct 24, and where the duct 24 is in a closed configuration, preventing the flow of air or the like from flowing past the blade 22 through the duct 24.

Attempts have been made to improve the ability to fix the blade in a particular orientation within the duct between fully open and fully closed configurations. As seen in FIG. 2, a lever 32 used with a regulating damping assembly, such as the assembly 20 illustrated in FIG. 1, is connected to a plate 34 having a slot 26. The lever 32 is held in any desired radial angular position by means of lever locking mechanism 38 that includes a bolt 40 which passes through the lever 32 and the slot 36. The head (not shown) of the bolt 40 engages one side of the slot 36 and a wing-nut 42 engages the other end of the bolt 40 in order to secure the lever 32 in a locked configuration. Tightening of the wing-nut 42 secures the head of the bolt 40 against the area of the plate 34 surrounding the slot 36, preventing the lever 32 from being able to be moved. Another example of this type of locking mechanism is described in U.S. Pat. No. 1,282,811.

However, conventional positioning locks, such as those described above, have certain disadvantages. For example, the use of the positioning lock is limited by the fact that a user cannot actually see the orientation of the blade within the duct. The use of a conventional positioning lock can result in a user guessing just how far open/closed the duct because the user cannot see the blade as it is being used.

Various attempts have been made to overcome the problems associated with conventional damper positioning locks. For example, U.S. Pat. No. 1,885,548 discloses a damper apparatus. However, this damper regulator is still limited in its ability to lock the lever, and by extension the blade, in an exact position. In another example, U.S. Pat. No. 2,345,997 discloses a dial damper regulator. However, this damper regulator still suffers from the same drawbacks as a wingnut and bolt combination are still used to lock the blade in position. In a further example, U.S. Pat. No. 3,073,564 discloses a damper regulator. However, this damper regulator also uses a wingnut and bolt combination to secure the lever in position and likewise suffers the same drawbacks as discussed above. In a further example, U.S. Pat. No. 5,169,121 discloses a damper control mechanism. However, this device requires the use of a motor and gear unit, a power supply and the like.

Accordingly, there is a need for a damper positioning lock that provides a number of exact locking positions. There is a further need for a damper positioning lock that provides for simple locking/unlocking of the lever. There is an additional need for a damper regulating lock that is simple and economical to manufacture. The present invention fulfills these needs and provides other related advantages.

SUMMARY OF THE INVENTION

The present invention resides in an apparatus that provides a damper positioning lock. As illustrated herein, an embodiment of a damper positioning lock includes a plate having a plurality of recesses along an arcuate edge and a damper positioning handle pivotally associated with the plate. A mechanism is associated with the handle for selectively engaging a selected one of the recesses.

The engaging mechanism includes a pin slidable relative to the plate for engaging the selected recess. The pin is also slidable relative to the handle for engaging the selected recess. The damper positioning lock also includes a mechanism for biasing the pin toward the recess. The biasing mechanism includes a spring disposed within the handle.

The engaging mechanism further includes a rod having the pin, the rod being slidable relative to the handle. The rod is adapted to slide within a channel of the handle, and movement of the rod in first and second directions within the channel causes, respectively, engagement and disengagement of the pin and the selected recess. A mechanism for biasing the pin toward the recess is disposed between the handle and the rod.

The damper positioning lock further includes a mechanism for selectively disengaging the pin from the selected recess.

The handle of the damper positioning lock includes a hub rotatably positioned in a plate aperture.

In another embodiment, the handle comprises first and second interconnected disks, and wherein the plate is disposed between the first and second disks.

In an additional embodiment, the arcuate edge comprises one edge of an arcuate slot.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
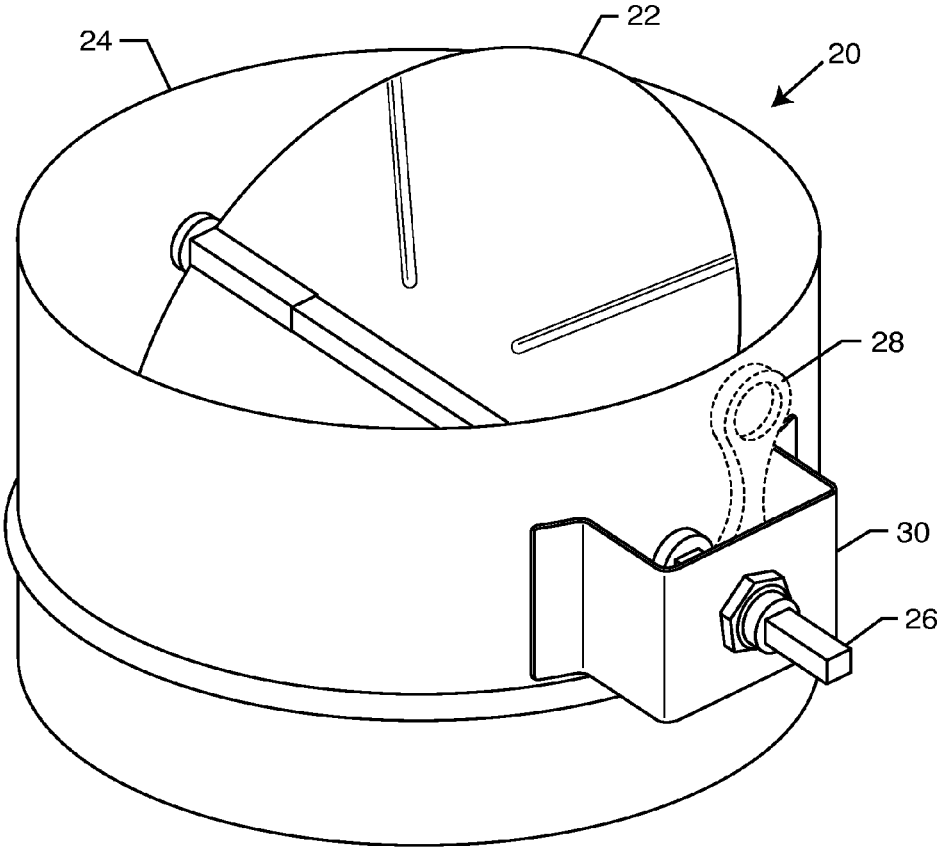
FIG. 1 PRIOR ART
FIG. 1 is a perspective view of a conventional damper regulating assembly.
Figure 2:
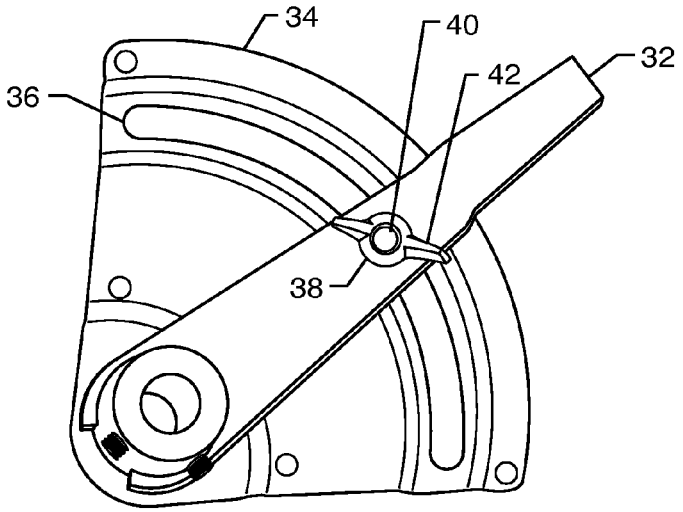
FIG. 2 PRIOR ART
FIG. 2 is a top plan view of a conventional damper positioning lock.

As shown in FIGS. 1-17 for purposes of illustration, the present invention is concerned with a damper positioning lock 20, 110, 170.

An embodiment of a damper positioning lock assembly 50, illustrated in FIGS. 3-7, includes a plate 52 and a damper positioning lever or handle 54 pivotally associated with the plate 52. The plate 52 is a generally planar body that can be made from various materials including, without limitation, metal, plastic, composite or the like. In the alternative, the plate 52 may be a center portion of a U-shaped bracket (e.g., bracket 30 of FIG. 1). The plate 52 includes a generally arcuate surface in the form of a slot 56 having a plurality of recesses 58 along one of the arcuate edges of the slot 56. A mechanism 60 is associated with the handle 54 for selectively engaging a selected one of the recesses 58. Accordingly, the engageable recesses 58 do not encompass items such as tick marks, scorelines, indentations or other markings incapable of receiving and locking the mechanism 60.

The plate 52 further includes a generally circular aperture 62 through which a generally cylindrical hub portion 64 extends from a generally disk-shaped end 66 of the handle 54. A fastener (not shown), such as a clip-on bearing, o-ring or the like, may be positioned about the hub portion 64 to secure the handle 54 to the plate 52. The circular aperture 62 and the arcuate slot 56 are aligned on the plate 52 such that the circular aperture 62 and the arcuate slot 56 share a common centerpoint 68. The hub portion 64 of the handle 54 also shares this centerpoint 68 and rotates about this centerpoint 68 within the aperture 62. The hub portion 64 includes a central bore 70 extending through the handle 54 through which a shaft extending from a duct (e.g., shaft 26 extending from duct 24 of FIG. 1) may extend. An axis 72 about which the shaft rotates extends through the centerpoint 68. The bore 70 is sized and shaped so as to engage the shaft. For example, the bore 70 is illustrated in cross-section as being generally square so that the bore 70 can engage a cross-sectionally square shaft, such as the shaft 26 of FIG. 1. Accordingly, as seen in FIGS. 3-7, the handle 54 extends perpendicular to and pivots about the axis 72.

Another end 74 of the handle 54 includes an eyelet 76 large enough for an adult finger to be inserted through. The handle 54 includes a channel 78 along a central portion 80 between the two ends 66, 74 of the handle 54. The channel 78 is illustrated as being generally U-shaped with linear sides meeting at right angles and an open side facing the plate 52. In the alternative, the channel 78 may also be cross-sectional semi-circular. A recess 82 is formed on the handle 54 creating a space between the channel 78 and the eyelet 76.

The engaging mechanism 60 includes a rod 84 disposed within and slidable along at least a portion of the length of the channel 78. The rod 84 is generally T-shaped with a cross bar 86 on one end 88 of the rod 84 being disposed within the recess 82. The cross bar 86 includes a slight detent 90 that is designed to accommodate a fingertip. The rod 84 includes a pin 92 extending perpendicularly away from a side of the rod 84 adjacent the open side of the channel 78 which faces the plate 52 such that the pin 92 extends through the arcuate slot 56. As the rod 84 slides along the channel 78, the rod 84 slides relative to the handle 54 which, in turn, slides the pin 92 relative to both the handle 54 and the plate 52. This slidable movement of the rod 84 in first and second opposite directions within the channel 78 causes, respectively, engagement and disengagement of the pin 92 and the selected recess 58. When the pin 92 is disengaged from all of the recesses 58, the pin 92 is slidable within the arcuate slot 56 as the handle 54 is rotated about the centerpoint 68 and the axis 72.

The damper positioning lock assembly 50 also includes a mechanism 94 for biasing the pin 92 toward the recess 82. The mechanism 94 comes in the form of a spring 96 disposed within the channel 78 of the handle 54, between one end 98 of the channel 78 and an end 100 of the rod 84 distal from the cross bar 86. The spring 96 offers resistance to compressive loading such that the spring 96 biases the rod 84 away from the end 98 of the channel 78 towards engagement of the pin 92 with one of the recesses 58 of the arcuate slot 56. Once the pin 92 engages one of the recesses 58, the handle 54 can no longer be rotated about the common axis 72. The spring 96 may come in a variety of forms including, without limitation, open-coil helical spring, closed-coil helical spring, compression spring, extension spring, torsion spring or the like. The biasing mechanism 94 can also be in the form a resilient, flexible member or material disposed within the channel 78 between the end of the channel 98 and the rod 84 where the flexible member or material offers resistance to compressive loading. The spring 96, in the form of an open-coil helical spring, is disposed about a cylindrical projection 102 on the end 100 of the rod 84.

The damper positioning lock assembly 50 further includes a mechanism 104 for selectively disengaging the pin 92 from the selected recess 58 by a user inserting a finger through the eyelet 76 of the handle 54 and pressing that finger against the detent 90 on the cross bar 86 of the rod 84 which, in turn, depresses the rod 84 against the spring 96, compressing the spring 96 within the channel 78 and moving the rod 84 further within the channel 78. Movement of the rod 84 into the channel 78 also moves the pin 92 out of engagement with whichever recess 58 the pin 92 had previously been engaging. When a user takes their finger off the cross bar 86, the spring 96 automatically pushes the rod 86 towards the end 88 of the handle 54 which results in the pin 92 moving into engagement with the nearest recess 58.

Figure 4:
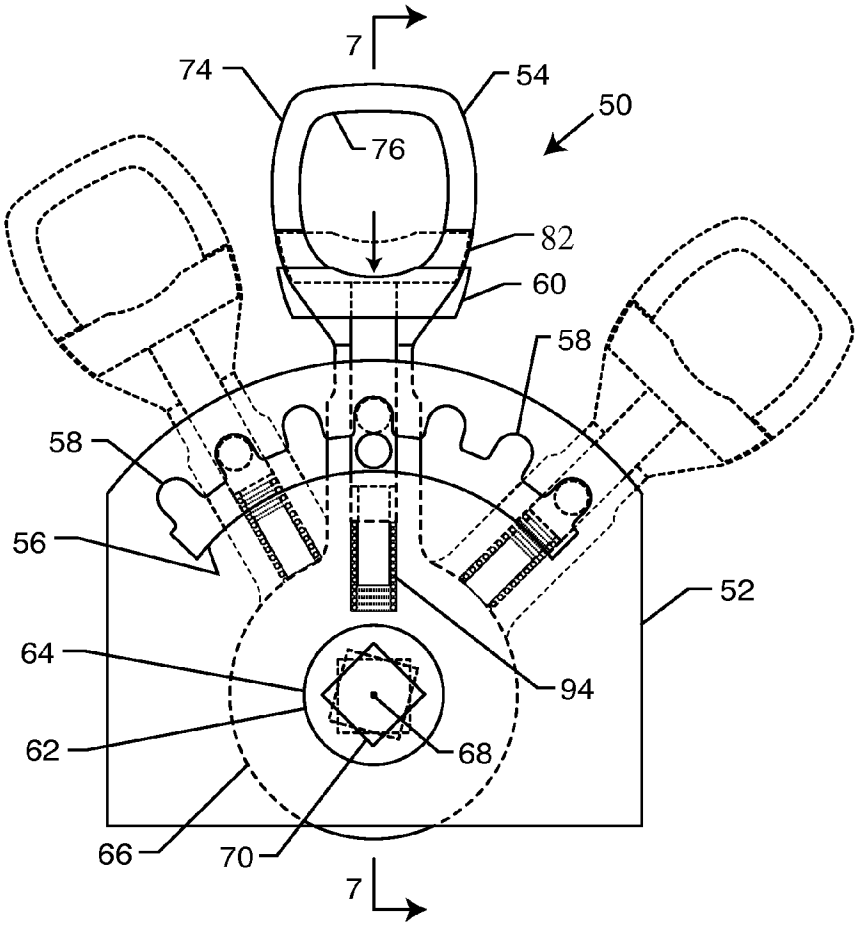
FIG. 4 is a top plan view of the damper positioning lock of FIG. 3 illustrating locking/unlocking of the damper positioning lock and movement of the handle between locking positions.
Figure 3:
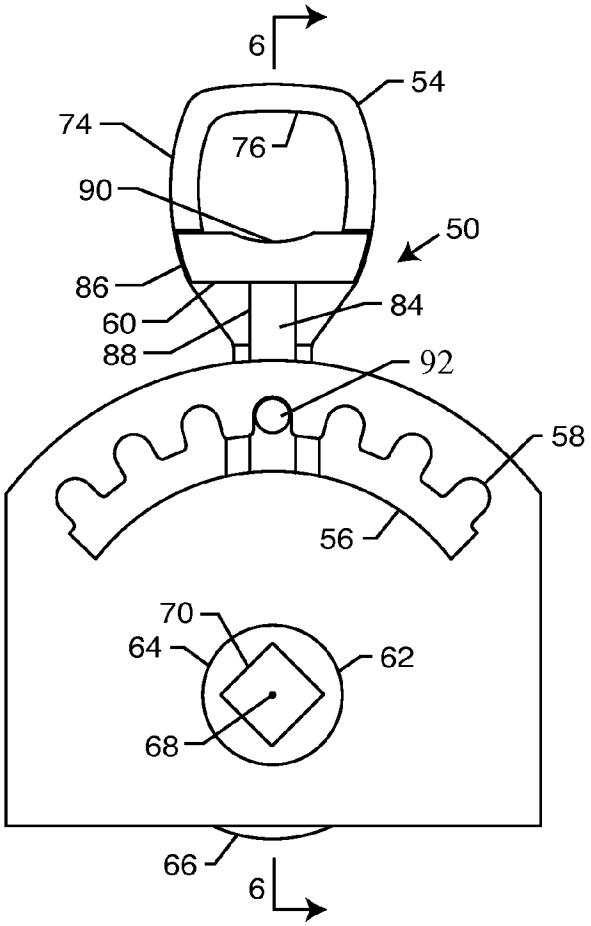
FIG. 3 is a top plan view of an embodiment of a damper positioning lock illustrating the damper positioning lock in a locked configuration.
Figure 7:
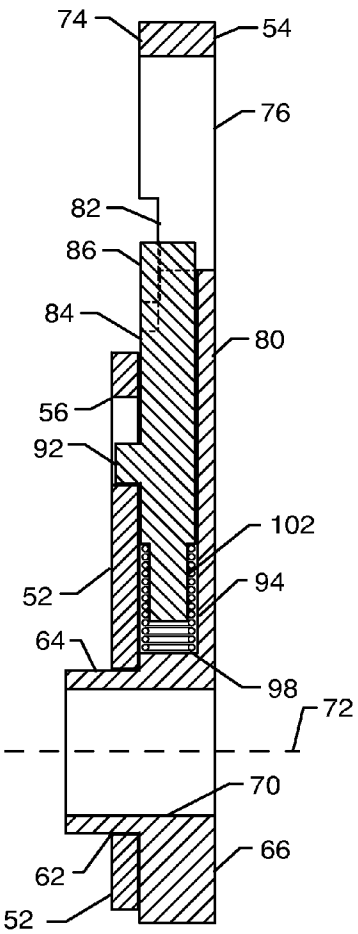
FIG. 7 is a cross-sectional view of the damper positioning lock taken generally along line 7-7 of FIG. 4.
Figure 6:
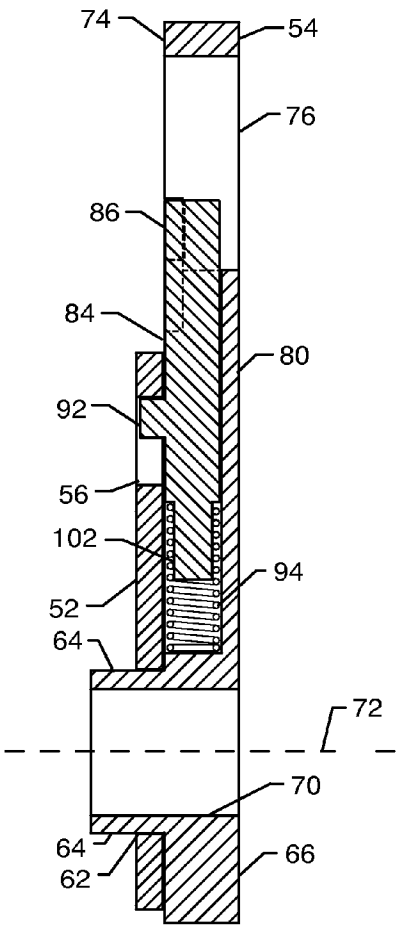
FIG. 6 is a cross-sectional view of the damper positioning lock taken generally along line 6-6 of FIG. 3.
Figure 5:
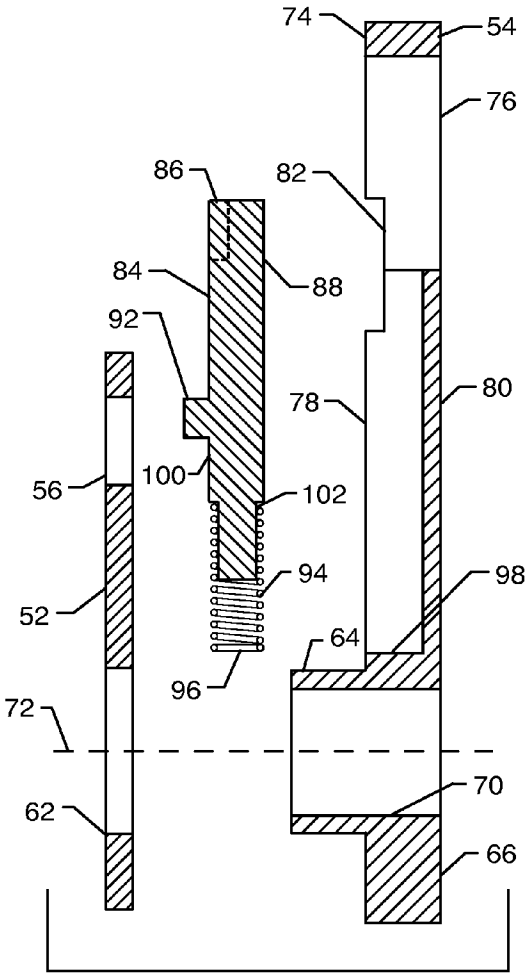
FIG. 5 is an exploded cross-sectional view of the damper positioning lock of FIG. 3.

In use, a user wishes to rotate the blade 22 within a duct 24 from being in a closed configuration blocking the flow of air or the like to an open configuration allowing the air or the like to flow within the duct 24 past the blade 22. When blade 22 is in a closed configuration, for the purposes of illustration only, the handle 54 of the damper positioning lock assembly 50 is in a locked configuration where the pin 92 engages the middlemost recess 58 along the arcuate slot 56, as seen in FIGS. 3 and 4. In order to move the blade 22 to an open configuration, the user engages the mechanism 104 for selectively disengaging the pin 92 from the selected recess 58 by inserting their finger through the eyelet 76 of the handle 54 and pressing that finger against the detent 90 on the cross bar 86 of the rod 84 which, in turn, depresses the rod 84 against the spring 96, compressing the spring 96 within the channel 78 and moving the rod 84 further within the channel 78 which, into turn, moves the pin 92 out of engagement with the middlemost recess 58. The user, with their finger still pressing against the detent 90 in order to keep the pin 92 within the slot 56, then rotates the handle 54 to either the left or the right to move the blade 22 into an open configuration that can range from minimally open to fully open with the only difference being the orientation of the blade 22 relative to its position in the closed configuration. When the user aligns the pin 92 with the recess 58 that corresponds with the desired amount of openness of the open configuration, the user then takes their finger off the cross bar 86 which allows the spring 96 to automatically pushes the rod 86 towards the end 88 of the handle 54 which moves the pin 92 into engagement with the selected recess 58.

Figure 9:
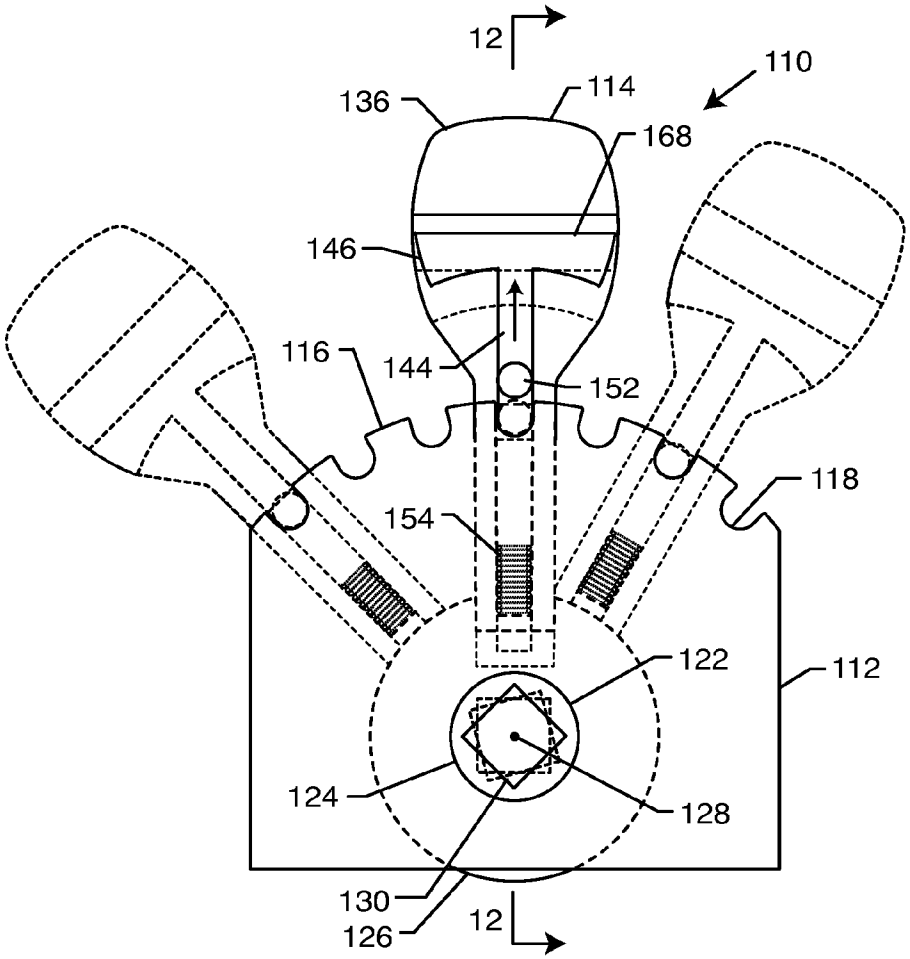
FIG. 9 is a top plan view of the damper positioning lock of FIG. 3 illustrating locking/unlocking of the damper positioning lock and movement of the handle between locking positions.

In the alternative, when the handle 54 is all the way to the left, as seen in FIG. 4, and the pin 92 engages the leftmost recess 58, the blade 22 could be in the closed configuration. Likewise, when the handle 54 is in the middle, as seen in FIG. 9, and the pin 92 engages the middlemost recess 58, the blade 22 could be in a half open/half closed configuration. Thus, when the handle 54 is all the way to the right, as seen in FIG. 4, and the pin 92 engages the rightmost recess 58, the blade 22 could be in the fully open configuration.

Another embodiment of a damper positioning lock assembly 110, illustrated in FIGS. 8-12, includes a plate 112 and a damper positioning lever or handle 114 pivotally associated with the plate 112. The plate 112 is a generally planar body that can be made from various materials including, without limitation, metal, plastic, composite or the like. In the alternative, the plate 112 may be a center portion of a U-shaped bracket (e.g., bracket 30 of FIG. 1). The plate 112 includes a generally arcuate surface in the form of an edge 116 having a plurality of recesses 118. A mechanism 120 is associated with the handle 114 for selectively engaging a selected one of the recesses 118.

The plate 112 further includes a generally circular aperture 122 through which a generally cylindrical hub portion 124 extends from a generally disk-shaped end 126 of the handle 114. A fastener (not shown), such as a clip-on bearing, o-ring or the like, may be positioned about the hub portion 124 to secure the handle 114 to the plate 112. The circular aperture 122 and the arcuate edge 116 are aligned on the plate 112 such that the circular aperture 122 and the arcuate edge 116 share a common centerpoint 128. The hub portion 124 of the handle 114 also shares this centerpoint 128 and rotates about this centerpoint 128 within the aperture 122. The hub portion 124 includes a central bore 130 extending through the handle 114 through which a shaft extending from a duct (e.g., shaft 26 extending from duct 24 of FIG. 1) may extend. An axis 132 about which the shaft rotates extends through the centerpoint 128. The bore 130 is sized and shaped so as to engage the shaft. For example, the bore 130 is illustrated in cross-section as being generally square so that the bore 130 can engage a cross-sectionally square shaft, such as the shaft 26 of FIG. 1. Accordingly, as seen in FIGS. 8-12, the handle 114 extends perpendicular to and pivots about the axis 132.

Another end 134 of the handle 114 includes a generally egg-shaped head portion 136. The handle 114 includes a rectangular block member 138 along a central portion 140 between the two ends 126, 134 of the handle 114 where the rectangular member is less wide than the width of the handle 114 and extends away from the handle 114 toward the plate 112. A recess 142 is formed on the handle 114 creating a space between the hub portion 124 and the egg-shaped head portion 136 that is interrupted only by the rectangular member 138.

The engaging mechanism 120 includes a rod 144 disposed within and slidable along at least a portion of the length of the recess 142. The rod 144 is generally T-shaped with a cross bar 146 on one end 148 of the rod 144 disposed within the recess 142 near the head portion 136 of the handle 114. The cross bar 146 includes a pair of detents 150 that are each designed to accommodate a fingertip. The rod 144 includes a pin 152 extending perpendicularly away from a side of the rod 114 adjacent the open side of the recess 142 which faces the plate 112 such that the pin 152 extends beyond the other side of the plate 112 from the handle 114 when the pin 152 engages one of the recesses 118. As the rod 144 slides along the recess 142, the rod 144 slides relative to the handle 114 and the plate 112 which, in turn, slides the pin 152 relative to both the handle 114 and the plate 112. This slidable movement of the rod 144 in first and second opposite directions along the recess 142 causes, respectively, engagement and disengagement of the pin 152 and the selected recess 118. When the pin 152 is disengaged from all of the recesses 118, the pin 152 is slidable adjacent to the arcuate edge 116, along an arc parallel to the arc of the arcuate edge 116, as the handle 114 is rotated about the centerpoint 128 and the axis 132.

The damper positioning lock assembly 110 also includes a mechanism 154 for biasing the pin 152 toward the recess 142. The rod 144 includes an elongated slot 156 extending through the rod 144 between the pin 152 and an end 158 of the rod 144. One end 160 of the slot 156 is adjacent the pin 152 and abuts against the side of the block member 138 nearest the head portion 136 of the handle 114 when the pin 152 engages the selected recess 118. An opposite end 162 of the slot 156 is near the end 158 of the rod 144. The mechanism 154 comes in the form of a spring 164 disposed within the recess 142 of the handle 114, between the end 162 of the slot 156 and an end 166 of the block 138 distal from the side nearest the pin 152. The spring 164 offers resistance to compressive loading such that the spring 164 biases the rod 144 away from the end 166 of the block 138 which, in turn, biases the pin 152 towards engagement with one of the recesses 118 along the arcuate edge 116. Once the pin 152 engages one of the recesses 118, the handle 114 can no longer be rotated about the common axis 132. The spring 164 may come in a variety of forms including, without limitation, helical spring (open coil, closed coil or the like), compression spring, extension spring, torsion spring or the like. The biasing mechanism 154 can also be in the form a resilient, flexible member or material disposed within the slot 156 between the end 166 of the block 138 and the end 162 of the slot 156 where the flexible member or material offers resistance to compressive loading. In the alternative, the spring 164, in the form of an open-coil helical spring, can be disposed about a cylindrical projection extending from the end 166 of the block 138.

The damper positioning lock assembly 110 further includes a mechanism 168 for selectively disengaging the pin 152 from the selected recess 118 by a user pressing fingertips against the detents 150 on the cross bar 146 of the rod 144 in a direction away towards the head portion 136 of the handle 114 which, in turn, pulls the end 162 of the slot 156 against the spring 164, compressing the spring 164 between the end 162 of the slot 156 and the end 166 of the block member 138. Movement of the rod 144 away from the hub portion 124 of the handle 114 also moves the pin 152 out of engagement with whichever recess 118 the pin 152 had previously been engaging. When a user takes their finger off the cross bar 146, the spring 164 automatically pushes the end 162 of the slot 156 away from the end 162 of the block member 138 which results in the pin 152 moving into engagement with the nearest recess 118.

Figure 8:
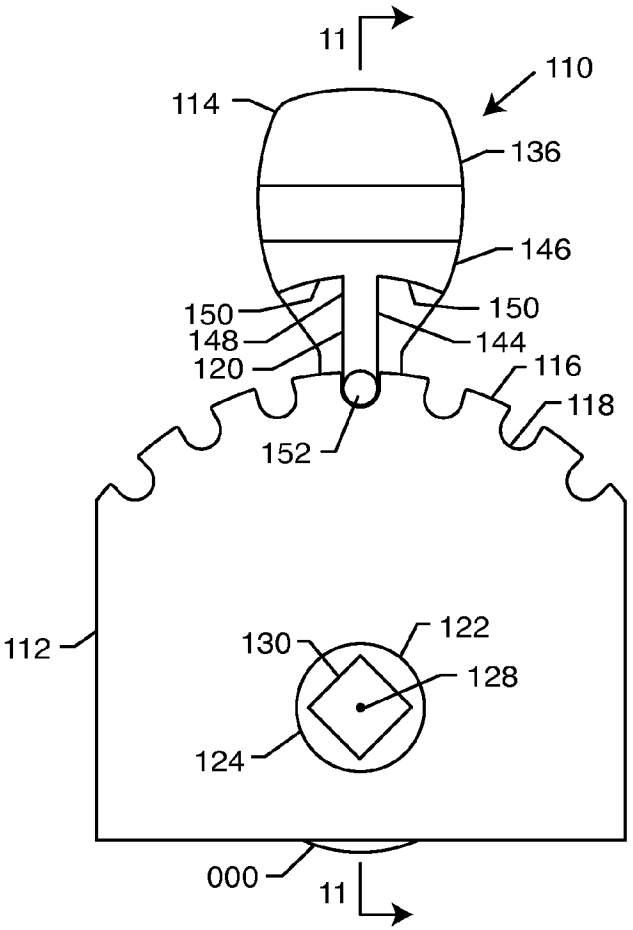
FIG. 8 is a top plan view of another embodiment of a damper positioning lock illustrating the damper positioning lock in a locked configuration.
Figure 12:
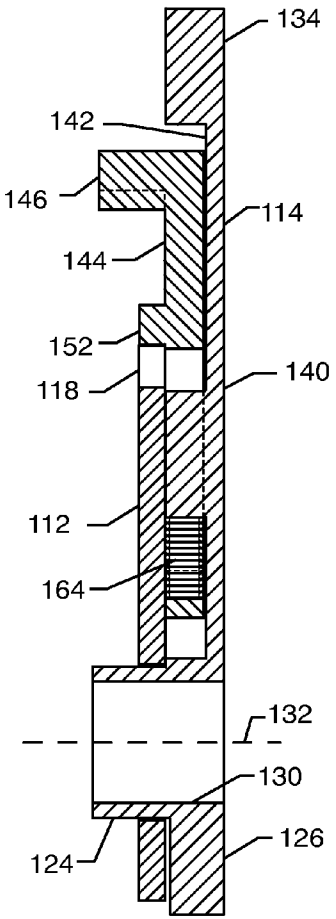
FIG. 12 is a cross-sectional view of the damper positioning lock taken generally along line 12-12 of FIG. 9.
Figure 11:
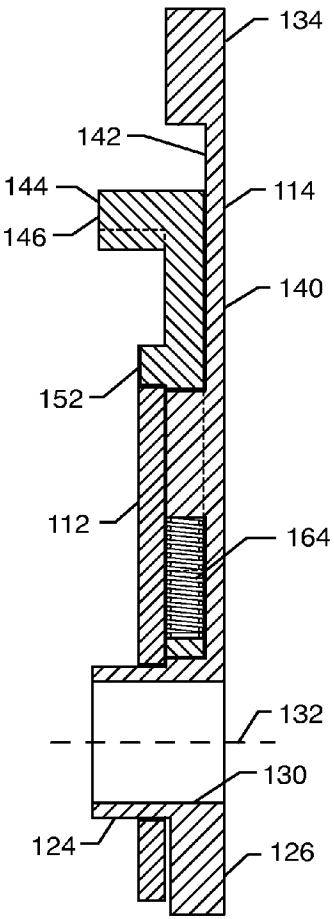
FIG. 11 is a cross-sectional view of the damper positioning lock taken generally along line 11-11 of FIG. 8.
Figure 10:
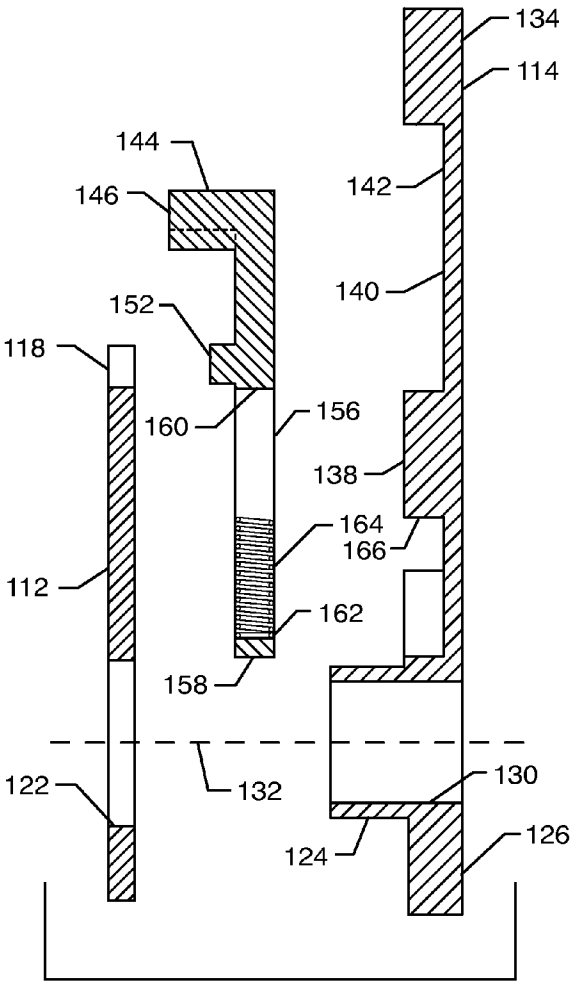
FIG. 10 is an exploded cross-sectional view of the damper positioning lock of FIG. 3.

In use, a user wishes to rotate the blade 22 within a duct 24 from being in a closed configuration blocking the flow of air or the like to an open configuration allowing the air or the like to flow within the duct 24 past the blade 22. When blade 22 is in a closed configuration, for the purposes of illustration only, the handle 114 of the damper positioning lock assembly 110 is in a locked configuration where the pin 152 engages the middle most recess 118 along the arcuate edge 136, as seen in FIGS. 8 and 9. In order to move the blade 22 to an open configuration, the user engages the mechanism 168 for selectively disengaging the pin 152 from the selected recess 118 by positioning fingertips along the detents 150 on the cross bar 146 of the rod 144 and pulling the cross bar 146 in a direction away towards the head portion 136 of the handle 114 which, in turn, pulls the end 162 of the slot 156 against the spring 164, compressing the spring 164 between the end 162 of the slot 156 and the end 166 of the block member 138. Movement of the rod 144 away from the hub portion 124 of the handle 114 also moves the pin 152 out of engagement with the middlemost recess 118. The user, with their fingers still pulling against the detents 150 in order to keep the pin 152 away from the arcuate edge 116, then rotates the handle 114 to either the left or the right to move the blade 22 into an open configuration that can range from minimally open to fully open with the only difference being the orientation of the blade 22 relative to its position in the closed configuration. When the user aligns the pin 152 with the recess 118 that corresponds with the desired amount of openness of the open configuration, the user then takes their finger off the cross bar 86 which allows the spring 156 to automatically pushes the end 158 of the rod 144 towards the hub portion 124 of the handle 114 which moves the pin 152 into engagement with the selected recess 118.

In the alternative, when the handle 114 is all the way to the left, as seen in FIG. 9, and the pin 152 engages the leftmost recess 118, the blade 22 could be in the closed configuration. Likewise, when the handle 114 is in the middle, as seen in FIG. 9, and the pin 152 engages the middlemost recess 118, the blade 22 could be in a half open/half closed configuration. Thus, when the handle 114 is all the way to the right, as seen in FIG. 9, and the pin 152 engages the rightmost recess 118, the blade 22 could be in the fully open configuration.

An additional embodiment of a damper positioning lock assembly 170, illustrated in FIGS. 13-17, includes a plate 172 and a damper positioning lever or handle 174 pivotally associated with the plate 172. The plate 172 is a generally flat, planar body that can stand alone or be a center portion of a U-shaped bracket that can be made from various materials including, without limitation, metal, plastic, composite or the like. The plate 172 includes a generally arcuate edge 176 and a plurality of recesses in the form of apertures 178 arranged along the edge 176 in an arc offset from and generally parallel to the arc formed by the arcuate edge 116. A mechanism 180 is associated with the handle 174 for selectively engaging a selected one of the apertures 178.

The plate 172 further includes a generally circular aperture 182 surrounded by hollow neck extending away from the plate 172. The handle 174 includes first and second disks 184, 186 where the plate 172 is disposed between the first and second disks 184, 186. The first and second disks 184, 186 are interconnected by a generally cylindrical, hollow hub portion 188 extending away from the second disk 186 through the aperture 182 of the plate 172 and a central bore 190 of the first disk 184. A fastener (not shown), such as a clip-on bearing, o-ring or the like, may be used to secure the first and second disks 184, 186 together. The circular aperture 182 and the arcuate edge 176 are aligned on the plate 172 such that the circular aperture 182, the arcuate edge 176, and the arc formed by the plurality of apertures 178 share a common centerpoint 192. The hub portion 188 of the handle 174 also shares this centerpoint 192 and rotates about this centerpoint 192 within the aperture 182. The second disk 186 includes a central bore 194 extending through the hub portion 188. A shaft extending from a duct (e.g., shaft 26 extending from duct 24 of FIG. 1) extends through this central bore 194. An axis 196 about which the shaft rotates extends through the centerpoint 192 and the central bore 194. The bore 194 is sized and shaped so as to engage the shaft. For example, the bore 194 is illustrated in cross-section as being generally square so that the bore 194 can engage a cross-sectionally square shaft, such as the shaft 26 of FIG. 1.

The engaging mechanism 180 includes a pin 198 extending away from a side of the second disk 186 towards the plate 172 such that the pin 198 extends beyond the other side of the plate 172 from the second disk 186 when the pin 198 engages one of the apertures 178. When the pin 198 is not engaging one of the apertures 178, the handle 174 is rotatable within the aperture 182 with the first and second disks 184, 186 rotating together as a single unit. As the handle 174 rotates about the axis 196, the pin 198 also rotates about the axis 196, relative to the plate 172. This rotatable movement of the handle 174 in first and second opposite directions (i.e., clockwise and counter-clockwise) allows for engagement and disengagement of the pin 198 and the selected aperture 178. When the pin 198 is disengaged from all of the apertures 178, the pin 198 is rotatable adjacent to the plate 172, along an arc parallel to and offset from the arc of the arcuate edge 176, and directly parallel with the arc formed by the plurality of apertures 178, as the handle 174 is rotated about the centerpoint 192 and the axis 196.

The damper positioning lock assembly 170 also includes a mechanism 200 for biasing the pin 198 toward the selected aperture 178. The mechanism 200 comes in the form of a spring 202 disposed about the hub portion 188, between the plate 172 and the first disk 184. The spring 202 extends into a recess 204 of the first disk 184 that faces the plate 172. The spring 202 offers resistance to compressive loading such that the spring 202 biases the pin 198 towards engagement with one of the apertures 178. Once the pin 198 engages one of the apertures 178, the handle 114 can no longer be rotated about the axis 196. The spring 202 may come in a variety of forms including, without limitation, helical spring (open coil, closed coil or the like), compression spring, extension spring, torsion spring or the like. The biasing mechanism 200 can also be in the form a resilient, flexible member or material disposed between the plate 172 and the first disk 184 where the flexible member or material offers resistance to compressive loading.

The damper positioning lock assembly 170 further includes a mechanism 206 for selectively disengaging the pin 198 from the selected aperture 178 by a user pressing a hand, palm, fingers or other body part against the first disk 184 in a direction towards the plate 172 which, in turn, pushes the second disk 186 away from the plate 172, compressing the spring 202 between the plate 172 and the first disk 184. Movement of the second disk 186 away from the plate 172 also moves the pin 198 out of engagement with whichever aperture 178 the pin 198 had previously been engaging. When a user takes their hand, palm, finger or other body part off the first disk 184, the spring 202 automatically pushes the first disk 184 away from the plate 172 which results in the second disk 186 moving toward the plate 172 and the pin 198 moving into engagement with the nearest aperture 178.

In use, a user wishes to rotate the blade 22 within a duct 24 from being in a closed configuration blocking the flow of air or the like to an open configuration allowing the air or the like to flow within the duct 24 past the blade 22. When blade 22 is in a closed configuration, for the purposes of illustration only, the handle 174 of the damper positioning lock assembly 170 is in a locked configuration where the pin 198 engages the middle most recess 178 along the arcuate edge 176. In order to move the blade 22 to an open configuration, the user engages the mechanism 206 for selectively disengaging the pin 198 from the selected recess 178 by pressing a hand, palm, fingers or other body part against the first disk 184 in a direction towards the plate 172 which, in turn, pushes the second disk 186 away from the plate 172, compressing the spring 202 between the plate 172 and the first disk 184. Movement of the second disk 186 away from the plate 172 also moves the pin 198 out of engagement with whichever aperture 178 the pin 198 had previously been engaging. The user, still pressing the first disk 184 toward the plate 172 in order to keep the pin 198 away from the apertures 178 along the arcuate edge 176, then rotates the handle 174 to either clockwise or counter-clockwise to move the blade 22 into an open configuration that can range from minimally open to fully open with the only difference being the orientation of the blade 22 relative to its position in the closed configuration. When the user aligns the pin 198 with the aperture 178 that corresponds with the desired amount of openness of the open configuration, the user then takes their hand, palm, finger or other body part off the first disk 184 which allows the spring 202 to automatically push the first disk 184 away from the plate 172 which also moves the second disk 186 toward the plate 172 which, in turn, moves the pin 198 into engagement with the selected aperture 178.

Figure 14:
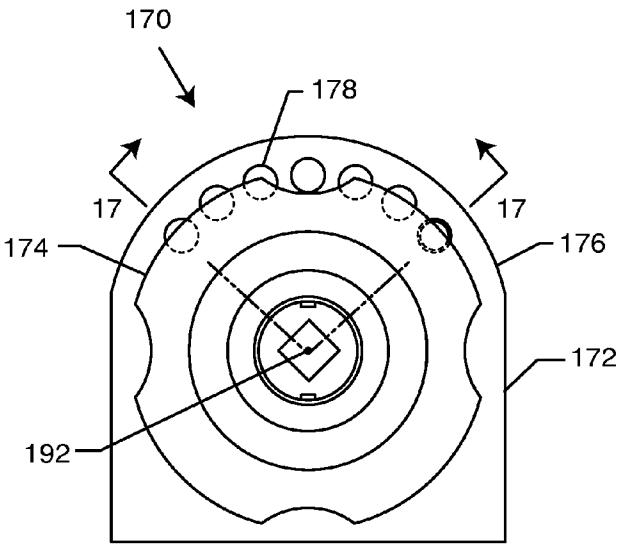
FIG. 14 is a top plan view of the damper positioning lock of FIG. 13 illustrating the handle engaging the plate in another one of the locking positions.
Figure 13:
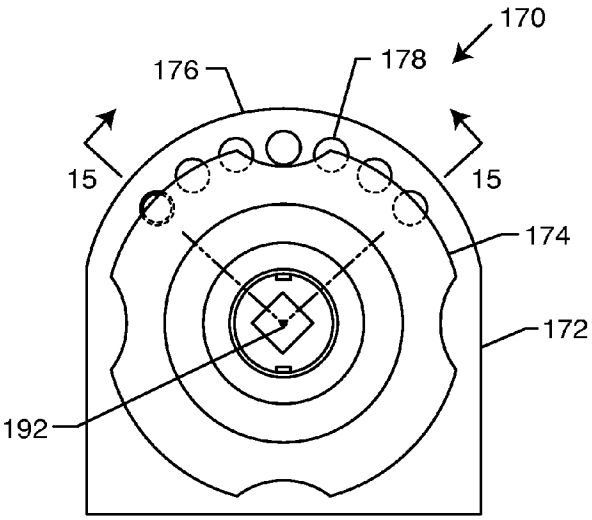
FIG. 13 is a top plan view of an additional embodiment of a damper positioning lock illustrating the damper positioning lock in a locked configuration engaging, the plate in one of a number of locking positions.
Figure 15:
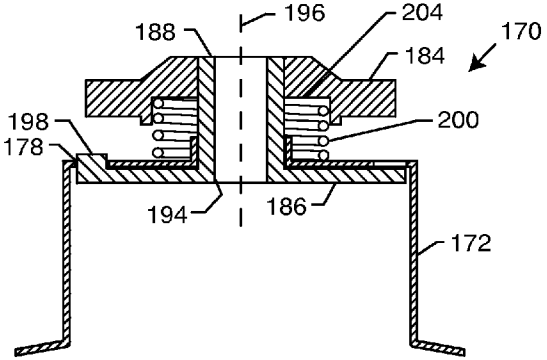
FIG. 15 is a cross-sectional view of the damper positioning lock of FIG. 13 taken generally along line 15-15 of FIG. 13 illustrating the lock in a locked configuration.
Figure 16:
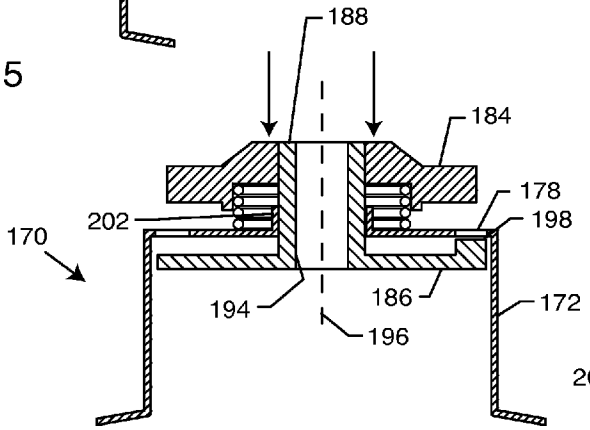
FIG. 16 is a cross-sectional view of the damper positioning lock illustrating the lock in an unlocked configuration after force is applied.
Figure 17:
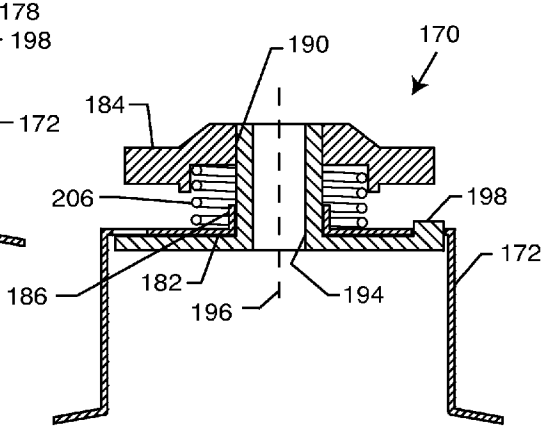
FIG. 17 is a cross-sectional view of the damper positioning lock taken generally along line 17-17 of FIG. 14.

In the alternative, when the handle 174 is turned, as seen in FIG. 13 such that the pin 198 engages the leftmost aperture 178, the blade 22 could be in the closed configuration. Likewise, when the handle 174 is in the middle, and the pin 198 engages the middlemost aperture 178, the blade 22 could be in a half open/half closed configuration. Thus, when the handle 174 is all the way to the right, as seen in FIG. 14, and the pin 198 engages the rightmost aperture 178, the blade 22 could be in the fully open configuration.

All features of the various embodiments discussed above can be mixed and matched to define an embodiment that is not directly illustrated in the accompanying figures.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A damper positioning lock, comprising:

a fixed plate having an aperture and an arcuate surface disposed around an axis of rotation passing through the aperture;

a plurality of recesses along an outer edge of the arcuate surface relative to the axis of rotation;

a damper positioning handle pivotally associated with the aperture of the fixed plate such that the damper positioning handle extends perpendicular from and pivots about the axis of rotation;

a rod slidably disposed within a channel on the damper positioning handle and moveable perpendicularly to the axis of rotation, and having a pin extending perpendicularly from the rod and disposed adjacent to the arcuate surface; and a spring associated with the damper positioning handle and rod so as to bias the rod in an extended position relative to the axis of rotation such that the pin engages one of the plurality of recesses;

wherein movement of the rod against the spring bias disengages the pin from said one of the plurality of recesses to permit pivotal movement of the damper positioning handle relative to the fixed plate.

2. The damper positioning lock of claim 1, wherein the spring is disposed between the rod and an end of the channel.

3. The damper positioning lock of claim 1, including means for selectively disengaging the pin from the one of the plurality of recesses.

4. The damper positioning lock of claim 3, wherein the handle includes a finger eyelet on an end spaced from the axis of rotation.

5. The damper positioning lock of claim 4, wherein the rod is generally T-shaped with a cross bar disposed adjacent to the finger eyelet.

6. The damper positioning lock of claim 5, wherein the cross bar has a detent configured to accommodate a finger tip.

7. The damper positioning lock of claim 6, wherein the detent comprises the means for selectively disengaging the pin from the one of the plurality of recesses.

8. A damper positioning lock, comprising:

a fixed plate having an aperture and an arcuate surface disposed around an axis of rotation passing through the aperture;

a plurality of recesses along an outer edge of the arcuate surface relative to the axis of rotation;

a damper positioning handle pivotally associated with the aperture of the fixed plate such that the damper positioning handle extends perpendicular to and pivots about the axis of rotation;

a rod slidably disposed within a channel on the damper positioning handle and moveable perpendicularly to the damper positioning handle axis of rotation, and having a pin extending perpendicularly from the rod and disposed adjacent to the arcuate surface;

a spring or resilient member disposed between the rod and an end of the channel and associated with the damper positioning handle and rod so as to bias the rod in an extended position relative to the axis of rotation such that the pin engages one of the plurality of recesses; and means for selectively disengaging the pin from the one of the plurality of recesses;

wherein movement of the rod against the spring or resilient member bias disengages the pin from said one of the plurality of recesses to permit pivotal movement of the damper positioning handle relative to the fixed slate.

9. The damper positioning lock of claim 8, wherein the handle includes a finger eyelet on an end spaced from the axis of rotation.

10. The damper positioning lock of claim 9, wherein the rod is generally T-shaped with a cross bar disposed adjacent to the finger eyelet.

11. The damper positioning lock of claim 10, wherein the cross bar has a detent configured to accommodate a finger tip.

12. The damper positioning lock of claim 11, wherein the detent comprises the means for selectively disengaging the pin from the one of the plurality of recesses.

13. The damper positioning lock of claim 1, wherein the arcuate surface comprises an arcuate slot.

14. The damper positioning lock of claim 1, wherein the axis of rotation is coextensive with a rotational axis for an associated damper shaft.

15. The damper positioning lock of claim 8, wherein the arcuate surface comprises an arcuate slot.

16. The damper positioning lock of claim 8, wherein the axis of rotation is coextensive with a rotational axis for an associated damper shaft.

* * * * *